US005511246A

United States Patent [19]

Farkas et al.

[11] Patent Number: 5,511,246

[45] Date of Patent: Apr. 30, 1996

[54] LOW LINT PROTECTIVE GARMENT

[75] Inventors: Allen D. Farkas, Hazel Crest, Ill.; Daniel C. Robb, Liverpool, N.Y.

[73] Assignee: Vallen Safety Supply Company, Houston, Tex.

[21] Appl. No.: 283,032

[22] Filed: Jul. 29, 1994

[51] Int. Cl.[6] ..... A41D 13/02

[52] U.S. Cl. ..... 2/79; 2/227; 2/237

[58] Field of Search ..... 2/76, 79, 270, 2/247, 253, 254, 227, 237, 236, 219, 235, 123, 69.5, 60; 24/102 A

[56] References Cited

U.S. PATENT DOCUMENTS

| | | | |
|---|---|---|---|
| 179,661 | 7/1876 | Lee | 2/DIG. 1 X |
| 1,012,648 | 12/1911 | Karp | 2/270 |
| 1,337,698 | 4/1920 | Gongora | 2/247 |
| 4,823,404 | 4/1989 | Morell et al. | 2/79 X |
| 4,860,382 | 8/1989 | Markwell | 2/79 X |
| 4,922,551 | 5/1990 | Anthes | 2/79 |
| 5,014,360 | 5/1991 | Smith et al. | 2/115 |

FOREIGN PATENT DOCUMENTS

| | | | |
|---|---|---|---|
| 420940 | 12/1934 | United Kingdom | 2/237 |
| 459943 | 1/1937 | United Kingdom | 2/237 |

*Primary Examiner*—C. D. Crowder
*Assistant Examiner*—Shirra L. Jenkins
*Attorney, Agent, or Firm*—Wood, Phillips, VanSanten, Clark & Mortimer

[57] ABSTRACT

A protective garment including a body section made of a material which generates a minimum of lint with two sleeves having hand openings. Each of the hand openings includes an elastic portion about a portion of the opening, an elastomeric button, and a plurality of buttonholes spaced around the other portion of the opening, whereby the hand opening may be adjusted between a selected number of sizes by selectively engaging the button with a selected one of the buttonholes. A pocket is defined in the garment with an interior side adjacent a wearer and an outer side adjacent the garment. An opening allows access to the pocket from the outside of the garment with a flap extending across the pocket opening and disposed between the interior and outer sides of the pocket and overlapping with the pocket interior side in a normal condition. An opening between the flap and the pocket interior side allow access to the garment interior from the outside of the garment. A waist adjuster includes an elastic portion about a portion of the waist of the torso section, a flap secured at one end to the waist of the torso section on the interior side of the body section and including a first snap at the other end, and a plurality of mating snaps spaced about the waist of the torso section on the interior side of the body section, whereby the waist of the torso section may be adjusted between a selected number of sizes by selectively engaging the first snap with a selected one of the mating snaps. The leg openings are provided with snaps on the front outer portion of the leg and a plurality of mating snaps spaced about the rear of the leg whereby the leg openings may be adjusted by selectively engaging the first snap with a selected one of the mating snaps to form a fold substantially in the rear of the leg.

4 Claims, 3 Drawing Sheets

LOW LINT PROTECTIVE GARMENT

BACKGROUND OF THE INVENTION

1. Technical Field

The present invention is directed toward garments, and more particularly toward low lint garments for use in painting booths and the like.

2. Background Art

In many work environments, protective clothing is important. For example, coveralls, aprons and the like have long been used to protect workers and/or their clothing from contamination by the job.

In some work environments, it is also important, even critical, to protect the job from contamination by the worker. One such example are "clean rooms" used to manufacture computer components. In such environments, it is important to protect the manufactured product from contamination.

In other environments, it is important to protect both the worker and the work. For example, in paint shops, particularly those which apply the paint electrostatically, it is important that all lint and dust be kept from the paint booth. It is well known that the electrostatic charge which helps to draw the paint to the surface being painted in such jobs will also draw any such lint and dust to the surface as well. Of course, such lint and dust will essentially ruin the quality of the paint job, not only in appearance but also its durability.

Accordingly, coveralls made of various non-linting, non-particulate generating materials have heretofore been used. Such coveralls must, however, be of a type which can be comfortably worn all day, as well as easily slipped on and off for persons needing to enter the work environment for only short periods. Still further, in order to meet those needs in a practical manner, it is important that only a few different sizes of coveralls be adequate to fit the wide variety of sizes of people in the work force.

Heretofore, coveralls have had only limited success in meeting the often conflicting goals of worker comfort and lint and dust prevention. For example, while loose, non-constrictive coveralls are desirable from a comfort standpoint, such clothing is often counterproductive to the job. That is, loose or baggy clothing is highly susceptible to accidental brushing against (and therefore marring) a painted surface.

Further, looseness at the wrists, cuffs, and/or neck opening results in gaps from which lint or dust on the worker's normal clothing can escape into the work environment. Attempts to close such openings by use of elastic have been somewhat successful in reducing escaped lint, but in order to meet that objective the elastic must be such that it closes around the smallest wrists, for example, and therefore it can be extremely uncomfortable and binding on workers having larger wrists. Buttons or snaps have also been used heretofore to provide some adjustability at such openings, but those snaps, particularly when used at the wrists, can themselves often scar the paint finish if the worker is not careful when handling the workpiece.

Still further, particularly for workers who will wear the garments for long periods of time, it is desirable that they have access to some pockets, for example to get a handkerchief or tissue when they step out of the paint booth, without having to remove the coverall. Merely providing a pocket in the coveralls themselves is not, however, wholly adequate since requiring a worker to keep a tissue in an outside pocket will itself be an obvious source of contamination through the pocket opening. Further, it is desirable to give a worker access to at least one of his normal clothes pockets, so that he can, for example, get coins for use in a vending machine during a work break if desired without the inconvenience of partially taking off the coverall just to get to his pocket. Again, however, this desired convenience can conflict with the desire to keep the workers clothes, and the lint they carry, contained inside the coverall.

The present invention is directed toward overcoming one or more of the problems set forth above.

SUMMARY OF THE INVENTION

In one aspect of the present invention, a protective garment for workers in environments requiring minimum contaminates is provided, including a body section made of a material which generates a minimum of lint with two sleeves having hand openings at their ends. Each of the hand openings includes an elastic portion about a portion of the opening, an elastomeric button, and a plurality of buttonholes spaced around the other portion of the opening, whereby the hand opening may be adjusted between a selected number of sizes by selectively engaging the elastomeric button with a selected one of the buttonholes.

In another aspect of the present invention, a pocket is defined in the garment with an interior side adjacent a wearer and an outer side adjacent the garment. An opening allows access to the pocket from the outside of the garment with a flap extending across the pocket opening and disposed between the interior and outer sides of the pocket and overlapping with the pocket interior side in a normal condition. An opening between the flap and the pocket interior side allow access to the garment interior from the outside of the garment.

In yet another aspect of the present invention, an adjuster for comfortably conforming the waist of the torso section to different wearers to minimize the risk of the torso section being accidentally brushed against a workpiece is provided, including an elastic portion about a portion of the waist of the torso section, a flap secured at one end to the waist of the torso section on the interior side of the body section and including a first securing means at the other end, and a plurality of second securing means spaced about the waist of the torso section on the interior side of the body section, whereby the waist of the torso section may be adjusted between a selected number of sizes by selectively engaging the first securing means with a selected one of the second securing means. A second such adjuster may also be provided for the waist of the torso section with the elastic portion disposed between the two adjusters.

In still another aspect of the present invention, the leg openings are provided with first securing means on the front outer portion of the leg and a plurality of second securing means spaced about the rear of the leg with at least one of the second securing means disposed substantially closer to the leg inner portion than the leg outer portion. The leg openings may be adjusted between a selected number of sizes to close over a worker's ankle by selectively engaging the first securing means with a selected one of the second securing means to form a fold substantially in the rear of the leg.

It is an object of the invention to provide a garment which will protect a worker's clothes from damage.

It is another object of the invention to provide a garment which will minimize contaminants introduced into the work environment by a worker, and thereby minimize any risk that the workpiece in the environment might be damaged by such contaminants.

It is a further object of the invention to provide a garment which can be easily and quickly put on and taken off by a worker.

It is another object of the invention to provide a garment which can be comfortably and conveniently worn over long periods of time.

It is yet another object of the invention to provide a garment which can be economically manufactured.

It is still another object of the invention to provide a garment which can be readily adapted to many different worker sizes.

Yet another object of the invention is to provide a garment which will present minimal danger of accidentally contacting and possibly damaging the workpiece in the work environment.

DESCRIPTION OF THE PREFERRED EMBODIMENT

Figure 1:
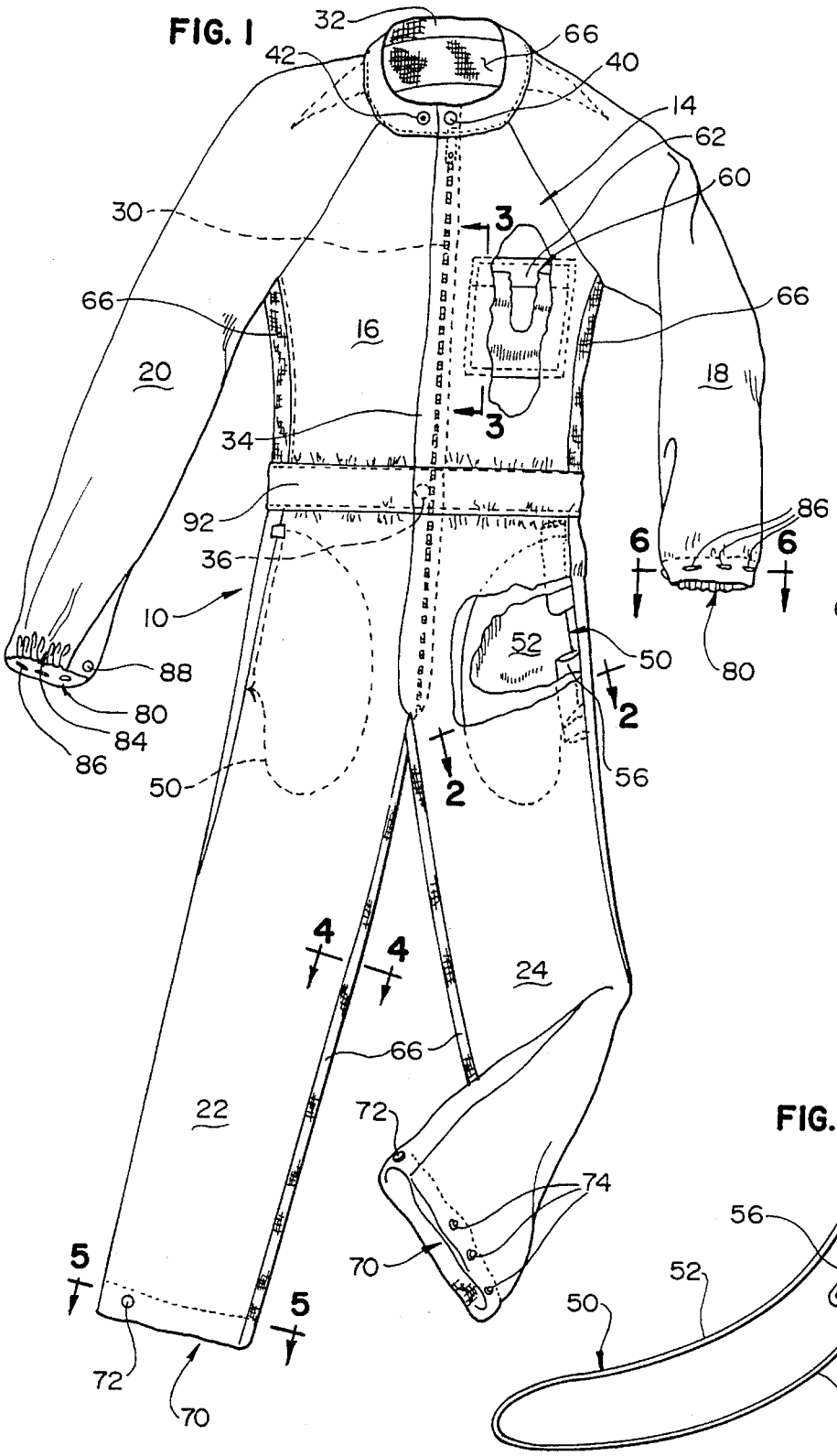
FIG. 1 is a front view of a garment embodying the present invention.

The protective garment 10 of the present invention is shown in FIG. 1. The garment 10 is adapted to be worn over a worker's clothes to both protect their clothes and also to protect the worker environment as further discussed below. The garment includes a main body section 14 with a torso section 16 from which two sleeves 18, 20 and two legs 22, 24 extend. Preferably, the garment is made of a woven polyester material, such as fabric sold by Stern & Stern under the name CHEMSTAT 909. Such material provides a degree of permeability and moisture transmission for the comfort of the wearer, while also being durable and resistant to tears. Such fabric is also of a low lint type (that is, it does not itself generate much lint). Further, such fabric tends to dissipate static charges, and therefore not only reduces the risk of damage to a workpiece or equipment from such static charge but also effectively minimizes the risk of bringing lint into the work environment (since with inappropriate materials a static charge can attract lint to the garment from which it might be released after the worker carries it into the work environment).

A zipper 30 (shown in phantom) is provided along the front of the body section 14, extending from the neck opening 32 substantially to the crotch. An overlying protective flap 34 is also provided, preferably with at least one snap 36 at about the waist to help to ensure that the flap 34 stays over the zipper 30 to ensure that the relatively hard zipper 30 will not be brushed against, and possibly damage, a workpiece being handled by the worker.

Each of the openings in the garment 10 also includes a configuration adapted to meet the often conflicting needs of lint prevention and worker comfort.

Specifically, the neck opening 32 includes one snap 40 on one side adapted to be secured to a selected one of a plurality of mating snaps 42 on the other side of the body section 14. (In FIG. 1, one such mating snap 42 is seen and the snap 40 is secured another such mating snap, which therefore cannot be seen). Accordingly, the neck opening 32 of the garment 10 can be adjusted to close the opening through which lint might escape from the worker's normal clothes without unnecessarily binding around the worker's neck. Of course, as a practical matter, if such adjustability were not provided, the worker on whom the opening would be too small would most probably not properly close the neck opening 32, with the result being an undesirable opening from which lint could escape.

Different pockets are also provided in the garment 10. It will be appreciated that if workers are expected to keep the garment 10 on for long periods of time, they will need to have access to some pockets or they might instead open the garment to get something from their clothes pockets with obviously undesirable release of lint and/or other contaminants intended to be trapped in the garment.

Figure 2:
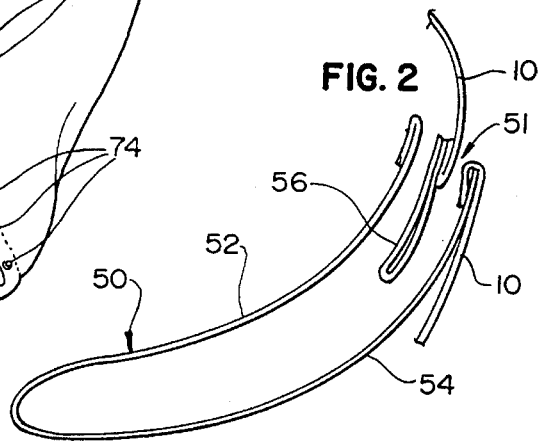
FIG. 2 is a cross-sectional view of a side pocket of the garment, taken along line 2—2 of FIG. 1.

Side pockets 50 are provided in the garment 10 substantially at locations overlying the position of a worker's own side pants pockets. As best shown in FIG. 2, the pockets 50 can be accessed through a slit opening 51 through the garment. The side pockets 50 are defined by an interior side 52 and an outer side 54 with the outer side 54 suitably secured, as by stitching, to the garment 10 and the interior side 52 is loose (that is, not connected to the garment 10) at the opening end of the pocket 50. A flap 56 is connected to the garment 10 on the other side of the pocket opening 51, which flap 56 overlies the loose end of the interior side 52 to provide a significant closure from the garment interior through the pocket 50. However, a worker can, by reaching into the pocket 50 and pulling the flap 56 aside, gain access into the interior of the garment 10, and thereby gain access into his own pants pockets. Thus, a containment if provided by the garment 10 while still allowing a worker reasonable access to his pants pockets when needed. Therefore, for example, should the worker need to get coins for a vending machine during a work break, he can quickly and easily do so without having to struggle with opening the zipper 30 and partially removing the garment 10.

Figure 3:
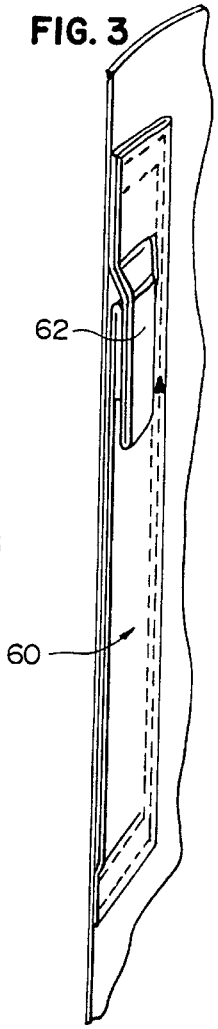
FIG. 3 is a cross-sectional view of a vest pocket of the garment, taken along line 3—3 of FIG. 1.

A vest pocket 60 is also provided on the interior of the garment 10. A flap 62 (see FIG. 3) is also provided over the top of the pocket 60 to provide additional containment of any lint in the pocket 60. Such pocket 60 is preferably not to be accessed when in the work environment, as it requires that the zipper 30 be opened at least a limited amount for a wearer to reach it. The vest location of the pocket 60 helps to ensure against a worker thoughtlessly introducing contaminants from the pocket, however, since it can be accessed only with the conscious thought of first opening the zipper 30. Thus, such vest pocket 60 is ideal, for example, for putting a handkerchief or tissues, since they could be reached relatively easily, but a worker would be likely to do so only when he is outside the clean work environment. In the case of tissues, that would be most desirable in view of the contaminants they would bring into the work environment.

Other pockets could also be provided in the garment 10 if desired, such as a rear hip pocket covered by a flap (like the vest pocket 60) but accessible from the exterior of the garment 10.

Ventilation panels 66 are also preferably provided in the garment 10. In the preferred embodiment (see FIG. 1), such panels are provided on an upper portion of the torso section 16, on opposite sides of the torso section 16 beneath the arms 18, 20, and along the inseam of each leg 22, 24. In the preferred embodiment, the ventilation panels 66 may be made of a polyester material, although such material is preferably formed of a looser weave or knit so as to have a higher permeability than the woven polyester of the remainder of the garment 10.

It should be recognized that the ventilation panels 66 as shown in the Figures are not only located at areas where ventilation might most advantageously be provided for the comfort of a wearer, but they are also at locations which are only minimally exposed by a wearer to the workpiece. Thus, to the minimal extent that such panels might allow contaminants to be introduced due to their greater permeability, such contaminants would be introduced where least likely to contact a workpiece.

Figure 4:
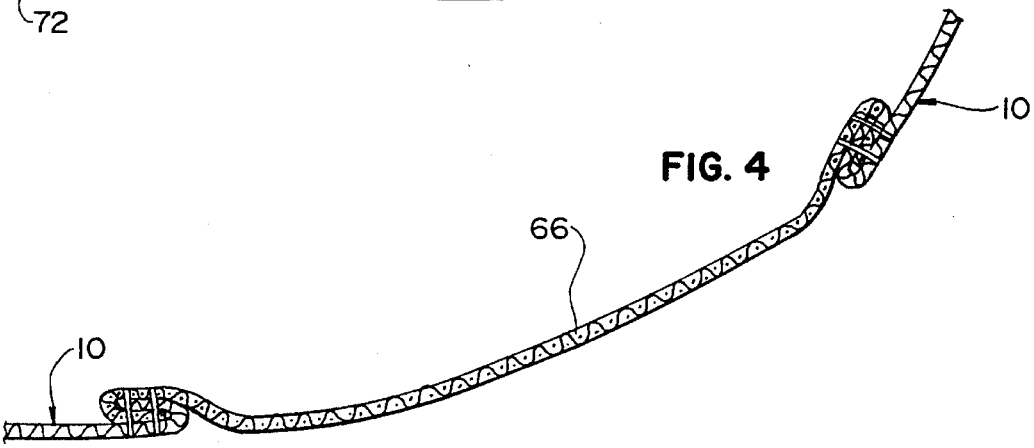
FIG. 4 is a cross-sectional view of a ventilation panel of the garment, taken along line 4—4 of FIG. 1.

The panels 66 should be suitably secured to the other material of the garment 10 so as to ensure that contaminants cannot pass through such seams from the garment interior. It is, in fact, preferred that each seam of the garment be felled (sewing one raw edge under the other and then stitching flat) such as shown in FIG. 4. While still other seam constructions (such as shown in other Figures) could be used within the scope of the invention, felled seams are believed to provide the highest quality and durability by eliminating free loose edges and thereby also eliminating the risk of contamination from loose threads typically found along the material edges.

Figure 5:
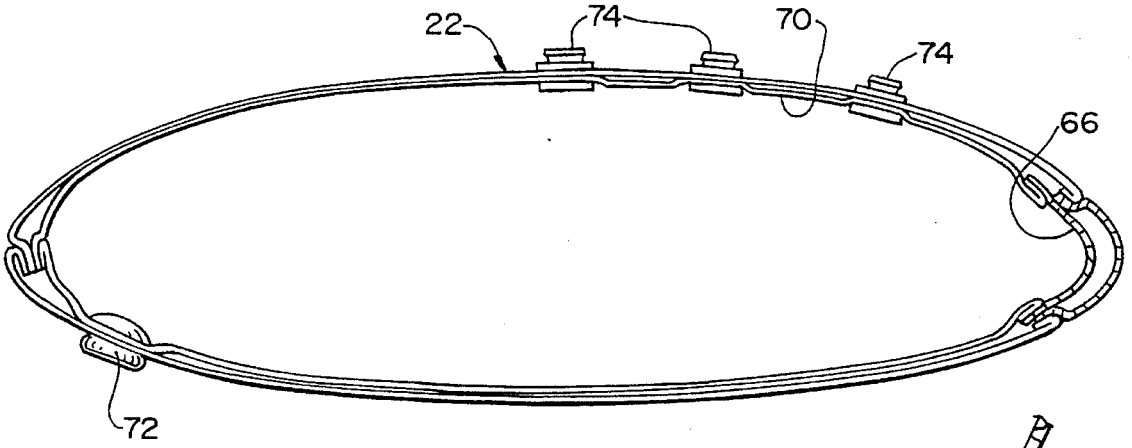
FIG. 5 is a cross-sectional view of a leg opening of the garment, taken along line 5—5 of FIG. 1.

The leg openings 70 are adjustable so as to permit such openings 70 to be closed to minimize any passage of contaminants from the garment interior. As best shown in FIG. 5, the leg openings 70 include one snap 72 and a plurality of spaced mating snaps 74. Because a relatively large opening 70 is desirable in order to allow a worker to easily fit his feet with shoes through the garment when putting it on, and a much smaller opening is thereafter desired to close around the worker's ankle, the one snap 72 is preferably located on the front outer portion of the leg 22, and the mating snaps 74 are preferably located on the rear of the leg 22 and toward the inner portion as shown in FIGS. 1 and 5.

With this configuration, when the snap 72 is not connected to one of the other snaps 74 as shown in FIG. 5, the largest opening 70 is provided. Typically, such large opening 70 makes it easy for the worker to put the garment 10 on without catching his shoes in the opening 70. The opening 70 is then closed up, depending on the size of the worker's ankle or boot tops, by connecting the one snap 72 to the one of the mating snaps 74 which leaves the garment 10 snug around the worker's ankle or boot tops.

Due to the positioning of the snaps 72, 74, it should be appreciated that when they are connected, the front of the leg 22 will remain essentially flat and a fold will be formed in the rear portion of the leg 22. Therefore, the extent to which the fold might otherwise have become an undesirable trap for lint or dust (or paint spray back) will be largely ameliorated by the fact that it will be at the rear, that is, at a location typically facing away from the workpiece (or paint). Further, the rear location of the fold when closed around a worker's ankle virtually eliminates the risk that such fold might be caught on an object when a worker walks around, thereby ensuring that the garment 10 will not be damaged, nor the worker or workpieces be damaged by tripping of the worker. Still further, it will be appreciated that this configuration will keep the ventilation panels 66 on the leg inseam unobstructed to provide maximum ventilation.

The sleeve openings 80 are also adjustable. However, because workers typically work with their hands, the closure of the sleeve openings 80 is particularly critical as any passage of contaminants out the ends of the sleeves 18, 20 is very likely to result in direct contamination of the workpiece.

Figure 6:
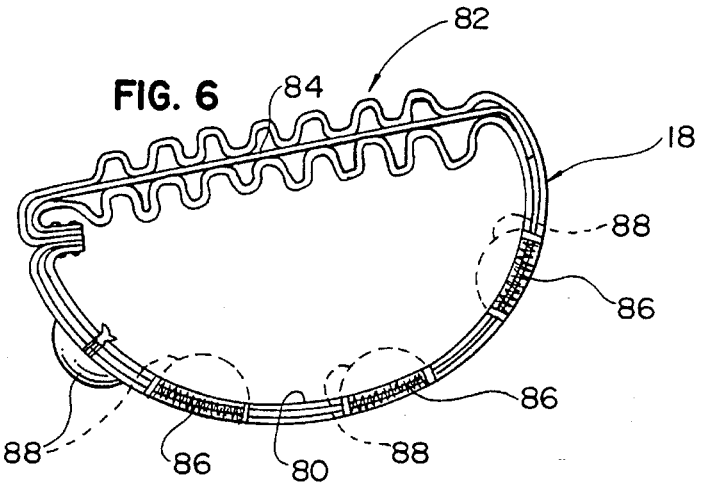
FIG. 6 is a cross-sectional view of a sleeve opening of the garment, taken along line 6—6 of FIG. 1.

Accordingly, as illustrated in FIG. 6, each sleeve opening 80 is provided with an elastic portion 82 formed, for example, by securing opposite ends of an elastic band 84 to the sleeve 18, 20. Preferably, the material at the end of the sleeve 18, 20 is turned or folded in to prevent fraying, and the elastic band 84 is secured in the channel formed by the turned in material. On the other portion of the sleeve end, a plurality of buttonholes 86 are defined, to selectively receive an elastomeric or rubber button 88 suitably secured to the outside of the sleeve 18, 20. The elastic portion 82 has an elastic range which is at least as great as the spacing between the buttonholes 86, and less than the distance between the button 88 and the buttonhole 86 furthest spaced from the button 88. Such an elastic range is large enough to provide full adjustment for all sizes between each adjacent button position but is not so great that the elastic portion 82 might be required to stretch to such an extent that it would result in excessive binding on the wrist of a wearer.

With this construction, the sleeve openings 80 can be selectively adjusted to accommodate different worker wrist sizes by attaching the button 88 to the appropriate one of the buttonholes 86. As shown in phantom in FIG. 6, when this is accomplished, the button 88 will either face inward away from the workpiece or, should the sleeve opening 80 fold over the other way (so that the button 88 faces away from the worker's wrist, it will be covered by the folded over portion of the opening associate with the buttonhole 86. Thus, the button 88 will be protected from the workpiece should the worker need to handle it. Further, the softness of the rubber button 88 will also serve to prevent scratching or other damage to the workpiece in the unlikely event that they were to come into direct contact. Of course, the softness of the button 88 will also serve to eliminate any irritation which the worker might otherwise feel from the button 88 against his wrist.

As should now be understood, the button 88 may be used to provide discrete different sizes to the sleeve opening 80, and the elastic portion 82 will provide an adjustment between those discrete sizes to ensure that there are no openings for contaminants out the sleeves 18, 20. However, since the adjustment required of the elastic portion 82 is essentially only the difference between those discrete sizes (i.e., the distance between the buttonholes 86), the elastic adjustment can be provided without the large binding forces often encountered with the prior art use of only elastic. That is, whereas full elastic adjustment able to fit the smallest wrist inevitably results in very tight elastic binding of a worker having large wrists. Over the course of a long work day, such tight binding is not only extremely uncomfortable, but it can also tend to reduce the worker's dexterity. It is not uncommon, therefore, for such prior art full elastic openings to be strain the elastic to an extent that, over time, they cease to retract properly to close the sleeve opening (in fact, sleeve openings which are too tight on a worker might even intentionally be damaged by the worker in order to reduce the binding on his wrist).

By contrast, with the combination elastic portion 82 and button 88 and buttonholes 86 of the present invention, the worker can adjust the sleeve openings 80 so as to close them against contamination with only minimal binding about the wrist. Since the elastic band 84 will not be under such great tension as full elastic bindings, it will not be so susceptible to strain and resulting reduced elasticity, nor will it invite intentional damage by the worker, and therefore will have a longer life. Still further, even if the band 84 should have some reduced elasticity, such stretching could be accommodated by simply using a different buttonhole 86 when closing the opening 80.

Figure 7:
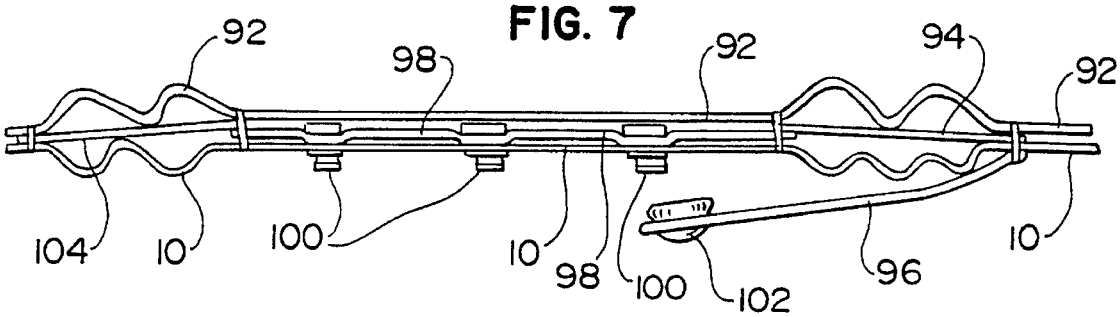
FIG. 7 is a cross-sectional view of the waist adjustment of the garment.

A waist adjuster 90 is also provided as shown in FIG. 7. This adjuster 90 is preferably provided in the back of the garment 10, with the snaps as discussed below on the garment interior so as to ensure that no workpiece be scratched from contact with a snap.

In the preferred embodiment of the waist adjuster 90, the waist of the torso section 16 includes a second outer strip of material 92 along the outside, stitched to the torso section 16 along its top and bottom to not only provide a strengthened portion therealong but to also define a channel therebetween.

In that channel in the back of the garment 10, one end of an elastic band 94 is suitably secured, as by stitches, in the channel, together with one end of a flap 96 secured to the interior side of the garment 10. The other end of the elastic band 94 is also suitably secured to the garment 10 and outer strip of material 92 such that when the band 94 is not stretched as shown in FIG. 7, both the outer strip 92 and the garment 10 are bunched to allow stretching.

Also suitably secured in the channel to the garment 10 and other end of the elastic band 94 is a belt section 98. The belt section 98 preferably does not stretch and serves as a strong foundation to which a plurality of mating snaps 100 are secured. The snap portions of the snaps 100 are open to the garment interior, and the heads of the snaps 100 are in the channel, with the outer strip 92 covering them to protect against accidentally scratching them against a workpiece, as well as to ensure containment of any contaminants even should the connection of the snaps 100 through the garment 10, over time, wear any small openings in the garment 10 and/or belt section 98.

A flap snap 102 is suitably secured to the free end of the flap 96. It should thus be recognized that this section of the adjuster 90 allows for a maximum dimension without the snaps 100, 102 connected and the elastic band 94 stretched to the limit of the garment 10 and outer strip 92, down to a minimal dimension in which the flap snap 102 is secured to the left snap 100 in FIG. 7. Adjustment is provided through selection of the snap 100 to which the flap snap 102 is connected.

A second waist elastic band 104 is also provided in the channel between the garment 10 and the waist outer strip 92 to also allow for automatic adjustment of the waist between the discrete positions definable by use of the snaps 100, 102. Thus, similarly to the sleeve opening adjustments, the waist size can be accommodated to fit the precise worker size without uncomfortably tightly squeezing the worker's waist.

Figure 8:
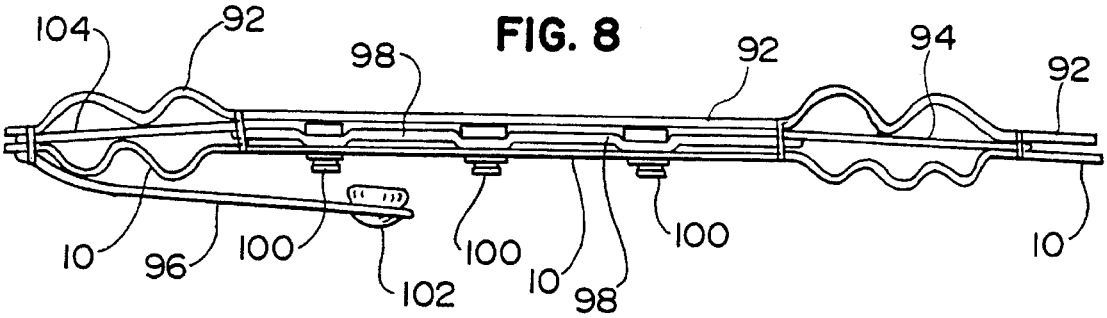
FIG. 8 is a cross-sectional view of a second flap and snap connection for adjusting the waist of the garment.

In a preferred embodiment of the invention, a second flap and snap connection, essentially the mirror image of that shown in FIG. 7, could also be provided on the other side of the second elastic band 104 (i.e., on the left end of FIG. 7). FIG. 8 shows this second flap and snap connection, with reference numerals comparable to those used in FIG. 7 also being used in FIG. 8. Such a dual adjuster structure would not only allow for a wide range of adjustments, but would also allow for even adjustment on both sides of the back of the garment 10 so as to avoid any feel or look that the adjuster 90 is twisting the garment 10 on the worker.

It should thus be appreciated that the waist adjuster 90 prevents billowing out of the waist of the garment 10. Since a worker might not recognize that the garment waist, if not near the worker's body, is near a workpiece until it is too late (for example, only after brushing against wet paint), this adjuster 90 helps to prevent such accidents by keeping the garment close to the worker's body (workers, of course, have a sense of where there body is when they lean over a workpiece but they have no such sense of where the garment is if it is not close to their body. Still further, it accomplishes this while at the same time permitting adjustment between many different worker waist sizes without being too loose on small waists or too tight on large waists, and thereby ensures both worker comfort and work convenience.

It should now be apparent that the garment 10 of the present invention will protect a worker's clothes from damage, while also minimizing contaminants introduced into the work environment by the worker to minimize any risk that the workpiece in the environment might be damaged by such contaminants. Such workpiece protection from contamination is, in particular, maximized in the area of the worker's body most likely to be placed near the workpiece, such areas presenting the greatest risk of workpiece contamination. Still further, the garment 10 is itself configured so as to minimize workpiece damage from accidental contact with the garment 10. Such dangers are found in many work environments, such as paint shops where workers must be around workpieces before the paint has completely dried.

All of the above advantages are provided by a garment 10 which can be easily and quickly put on and taken off by a worker, can be comfortably and conveniently worn over long periods of time, and can be readily adapted to many different size workers. Such garment 10 can not only be economically manufactured, but it will also provide reliable contaminant containment over a long useful life.

Still other aspects, objects, and advantages of the present invention can be obtained from a study of the specification, the drawings, and the appended claims.

We claim:

1. A protective garment for workers in environments requiring minimum contaminates, comprising:

a body section including a torso section with two sleeves and two legs, said torso section having a front zipper opening extending to a neck opening, said sleeves at their ends having hand openings, and said legs at their ends each having leg openings, said body section being made of woven polyester;

ventilation panels of higher permeability than the woven polyester on an upper portion of the torso section, on opposite sides of the torso section and along one side of each leg;

each of said hand openings including a first elastic portion about a portion of the opening, an elastomeric button, and a plurality of buttonholes spaced around the other portion of the opening, whereby said hand opening may be adjusted between a selected number of sizes by selectively engaging the elastomeric button with a selected one of the buttonholes; and an adjuster for conforming the waist of the torso section to different wearers, including:

a second elastic portion about a portion of the waist of the torso section, a flap secured at one end to the waist of the torso section on the interior side of the body section and including a first securing means at the other end, a plurality of second securing means spaced about the waist of the torso section on the interior side of the body section, whereby the waist of the torso section may be adjusted between a selected number of sizes by selectively engaging the first securing means with a selected one of the second securing means.

2. The garment of claim 1, wherein said button is secured to the outside of its sleeve, whereby said button when secured in one of the buttonholes is folded in a portion of the sleeve.

3. The garment of claim 1, wherein a wearer is on an interior side of the garment and further comprising:

a pocket defined in the garment with an interior side adjacent a wearer and an outer side adjacent the garment;

an opening allowing access to the pocket from the outside of the garment;

a flap across the pocket opening and disposed between the interior and outer sides of the pocket, said flap overlapping with the pocket interior side in a normal condition; and an opening between the flap and the pocket interior side allowing access to the garment interior from the outside of the garment.

4. The garment of claim 1, further comprising a second adjuster for conforming the waist of the torso section to different wearers, including:

a second flap secured at one end to the waist of the torso section on the interior side of the body section and including a third securing means at the other end, a plurality of fourth securing means spaced about the waist of the torso section on the interior side of the body section, whereby the waist of the torso section may be adjusted between a selected number of sizes by selectively engaging the third securing means with a selected one of the fourth securing means wherein said second elastic portion is in the back of the torso section and disposed between said first and second adjusters.

* * * * *